US005341610A

United States Patent [19]

Moss

[11] Patent Number: 5,341,610

[45] Date of Patent: Aug. 30, 1994

[54] PORTABLE DOME-SHAPED STRUCTURE

[76] Inventor: C. William Moss, 7830 E. Pecos La., Scottsdale, Ariz. 85253

[21] Appl. No.: 920,257

[22] Filed: Jul. 27, 1992

[51] Int. Cl.[5] ..... E04B 7/08

[52] U.S. Cl. ..... 52/82; 52/80.1; 52/81.1; 52/199

[58] Field of Search ..... 52/81.1, 81.3, 82, 582, 52/584, 80.1, 80.2, 198, 302.1, 199

[56] References Cited

U.S. PATENT DOCUMENTS

| | | | |
|---|---|---|---|
| 3,562,975 | 2/1971 | Moss | 52/82 X |
| 3,591,993 | 7/1971 | Reeves | 52/584 |
| 3,675,380 | 7/1972 | Moss | 52/82 X |
| 3,751,862 | 8/1973 | Linecker . | |
| 3,886,961 | 6/1975 | Geiger et al. . | |
| 4,063,566 | 12/1977 | Millerioux . | |
| 4,064,663 | 12/1977 | Moss . | |
| 4,425,740 | 1/1984 | Golden | 52/81.1 |
| 4,584,800 | 4/1986 | Burt et al. . | |
| 4,593,504 | 6/1986 | Bonnici et al. | 52/302.1 |
| 4,794,742 | 1/1989 | Henderson . | |
| 4,886,084 | 12/1989 | Lawrence et al. . | |

*Primary Examiner*—Carl D. Friedman
*Assistant Examiner*—Kien Nguyen
*Attorney, Agent, or Firm*—Marshall & Melhorn

[57] ABSTRACT

A light-weight portable structure having a plurality of planar panels joined together to form a dome-shaped structure. The generally trapezoidal-shaped panels have arcuate side edges instead of linear side edges in order to create the proper tension and cause the flexible panels to form the desired dome structure. The individual panels are joined together by H-shaped connectors extending the full side length of the panels. The side edges of the panels are fitted with a U-shaped locking caps before being inserted into the connectors. The caps of adjacent side panels are inserted into the open ends of the H-shaped connectors and are held in place by the connectors. As the panels are connected in series standing upright on the base edges of the panels, the cumulative forces used to insert the panels causes the partial structure to curve in a spiral manner. The spiral is unwound and the panels are pushed out at the base of the panels to form the circular shape of the structure and to connect the two free ends of the series of panels. This process transfers forces towards the narrower, top edge of the panels, which causes the panels and connectors to bend towards the center of the structure to form a dome.

5 Claims, 3 Drawing Sheets

PORTABLE DOME-SHAPED STRUCTURE

BACKGROUND OF THE INVENTION

1. Field of the Invention

This invention relates to dome-shaped structures, and in particular, portable structures of one or more domes built from flexible structural panels joined together by flexible connectors.

2. Summary of the Related Art

The need for temporary and permanent low cost housing structures is a global concern. The temporary structures may be used in connection with the homelessness problem, disaster relief, sudden overpopulation, military actions, and other similar situations.

In countries experiencing a sudden influx of refugees, housing is generally a problem. Throughout the world, caring for the homeless has become an important issue. Disaster relief organizations often have a need for temporary structures near the disaster site for housing and administrative purposes. Prison overcrowding is another problem involving the lack of adequate structures for housing individuals.

The increase cost of building materials and the continuing need for temporary shelter has created the need for a portable structure which can be built on a cost effective basis, used for a temporary or extended period of time, and disassembled and reused again at a different location.

An approach now common in the design of portable structures is to create thin shells which are congruent to curved surfaces. Various dome, cylindrical, and conical shaped structures have been developed. Of particular interest for the present invention are shell structures composed of flat two-dimensional materials which are forced into bending, and thus curved to create a structure of sufficient strength.

U.S. Pat. No. 3,751,862 to Linecker discloses a pneumatically supported structure with elongate anchor elements spanning the structure. A dome-shaped cover is formed from flexible segments spanning the space between the two anchor elements.

A portable structure utilizing flexible arches with tension membranes and stress cables is shown in U.S. Pat. No. 3,886961 to Geiger. The components are interconnected with each other. A dome-shaped structure with split arches and a center dome ring and multi-dome clusters of dome structures are also disclosed.

U.S. Pat. No. 4,584,800 to Burt et al discloses a building structure formed of a plurality of polyhyparic surfaces arranged to have common structural members along the periphery of the structure. U.S. Pat. No. 4,794,084 to Henderson shows a multi-conic shells which can be variously designed and used for building structures and panel structures.

SUMMARY OF THE INVENTION

In accordance with the present invention, there is provided a portable structure, and more particularly, a light-weight portable structure having a plurality of planar panels joined together to form a dome-shaped structure.

The panels are made of a flexible material and are generally trapezoidal in shape such that the two parallel sides form the base edge and the top edge of the panels in the structure. The two side edges of the panels are mirror images of each other and have an overall inward angle from the base edge to the top edge of the panel. The panels, however, have arcuate side edges instead of linear side edges in order to create the proper tension to cause the flexible panels to form the desired dome structure.

The individual panels are joined together by H-shaped connectors extending the full side length of the panels. The elongate connectors are made of light-weight polyvinyl chloride or other similar material. The side edges of the panels are fitted with a U-shaped locking caps before being inserted into the connectors. The caps of adjacent side panels are inserted into the open ends of the H-shaped connectors and are held in place by the connectors.

In order to insert the arcuate side edges of the panels into the connectors, manual force must be used to twist the panel and connector into the proper alignment. This force causes the panel and the connector to flex inward instead of maintaining a planar alignment.

As the panels are connected in series standing upright on the base edges of the panels, the cumulative forces used to insert the panels, which is also referred to as membrane build up, causes the partial structure to curve in a spiral manner. Once all of the panels have been connected in series, the spiral is unwound and the panels are pushed out at the base of the panels to form the circular shape of the structure and to connect the two free ends of the series of panels. This process transfers forces towards the narrower, top edge of the panels, which causes the panels and connectors to bend towards the center of the structure to form a dome. When the two free ends are finally connected, a rigid dome structure is formed.

The side panels, support beams, and other necessary material may be transported to the site in a planar, unassembled condition. The materials are light-weight and relatively compact. In constructing a typical twenty foot diameter dome structure, two individuals can assemble the panels and connectors in a relative short period of time.

Once the main dome structure has been completed, the ventilation cap, door panels, linking modules, and other modifications and accessories may be added.

An object of the present invention is to provide a low cost portable housing structure that is easy to transport and that is convenient to assemble and disassemble.

Another object of the present invention is to provide a connector with the flexibility to bend into a dome configuration, yet retain sufficient rigidity to maintain the structural integrity of the dome-shaped structure.

A further object of the present invention is to provide a locking means to secure the panels after the edge of the panel has been inserted into the connector.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
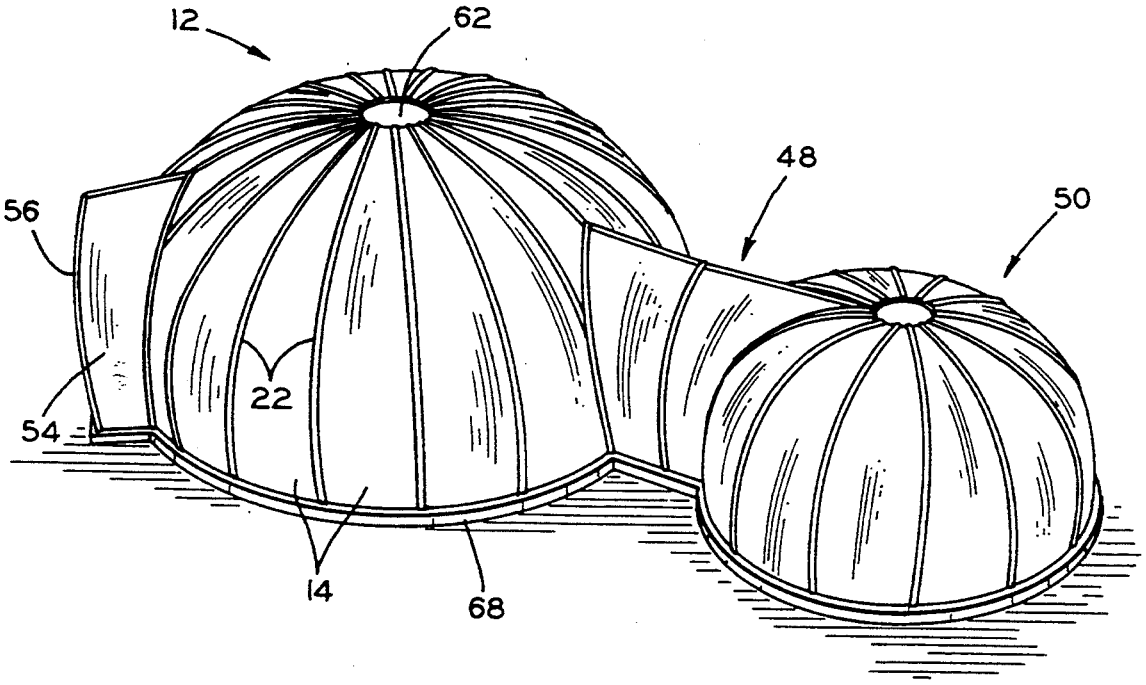
FIG. 1 is a perspective view of a structure including two dome-shaped structures and a linking module.
Figure 2:
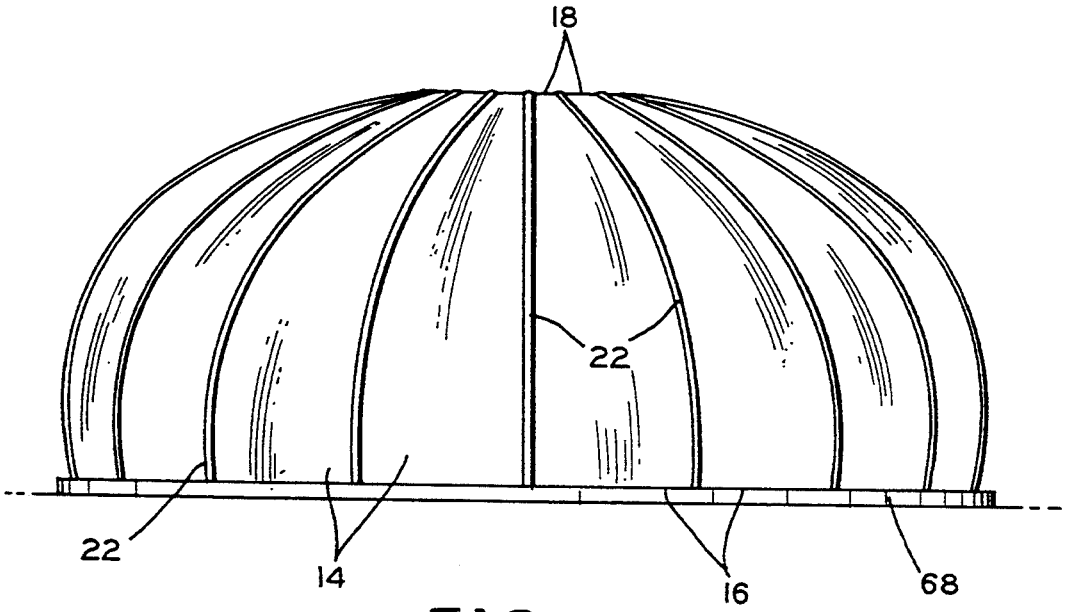
FIG. 2 is a front view of a dome-shaped structure of the present invention.
Figure 3:
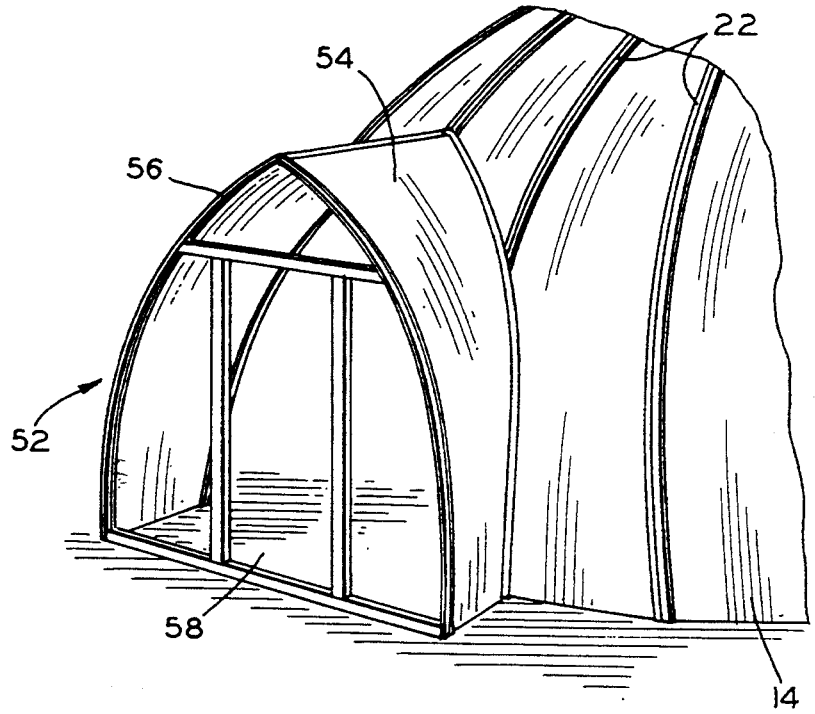
FIG. 3 is a segment of a dome-shaped structure with a door and vestibule.

Referring now to the drawings, there is shown in FIGS. 1–3 the dome-shaped structure 12 of the present invention. The panels 14 for the dome-shaped structure 12 are flexible planar membranes formed from corrugated polypropylene or other plastic material. Flexible plywood or sheet metal may also be employed.

The flexible panels 14 are provided with a base edge 16 and a top edge 18 in parallel, with the base edge 16 being longer than the top edge 18. The arcuate side edges 20 of the panel 14 are mirror images of each other. The arc of the side edges 20 is important to the formation of the dome-shaped structure 12, as the force used to align and connect the adjacent side edges 20 is transferred towards the top edge 18 of the panel 14 to cause the panel 14 to curve inward.

Figure 4:
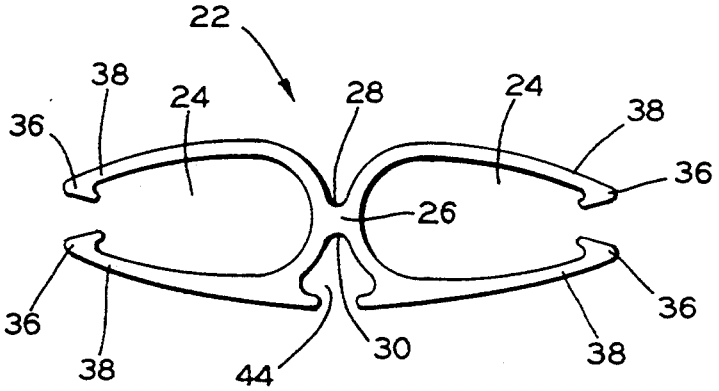
FIG. 4 is a cross sectional view of the elongate connector.
Figure 5:
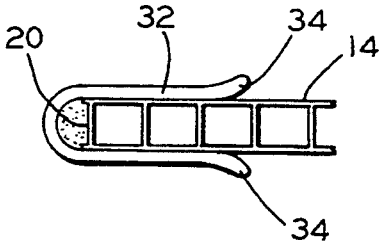
FIG. 5 is a cross sectional view of the U-shaped locking cap on the side edge of a panel.
Figure 6:
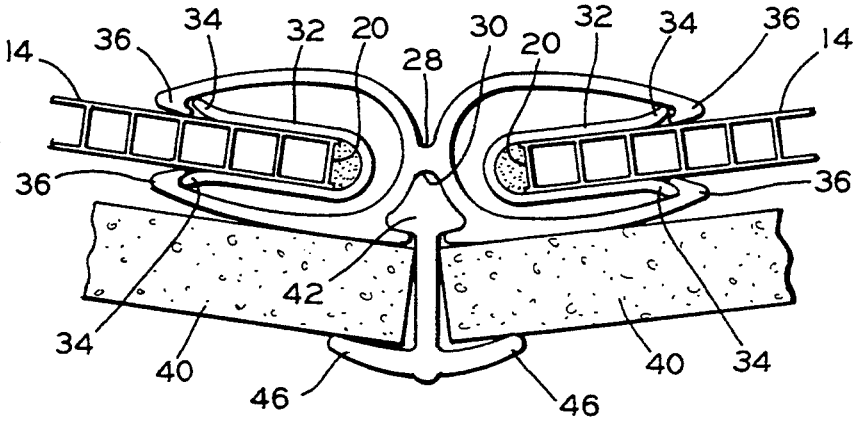
FIG. 6 is a cross sectional view of the connector with two panels inserted and with a T-shaped adapter inserted into an outer channel of the connector for securing insulation sheets.

The adjacent panels 14 are connected by the elongate connectors 22, as shown in FIGS. 4–6. The flexible connector 22 is made of polyvinyl chloride or other plastic material. The connector 22 includes two longitudinal channels 24 for receiving the panels 14. The channels are flexible about the center piece 26 of the connector 22. The internal segment 28 of the center piece 26 is in compression and the external segment 30 is in tension. The connector 22 structural rigidity with proper flexibility to achieve both the desired longitudinal arc and the cross-sectional flex.

A locking cap 32 is glued or otherwise secured to the panel 14 to cover the full length of side edge 20. The locking cap 32 is designed to be inserted into channel 24 of connector 22. After the locking cap 32 is inserted in the channel 24, the raised ends 34 of the cap 32 engage the hooks 36 on the end of channel arms 38 of connector 22 to prevent the unintentional disengagement of the panels 14 from the connector 22. When the connector 22 is flexed, the engagement of the hooks 36 against the panels 14 and raised cap ends 34 effectively seals the seams between adjacent panels 14.

FIG. 6 shows the connector 22 with adjacent panels 14 fully inserted. Also shown in FIG. 6 is a means for mounting insulation sheets 40 or other protective material on the panels 14. A T-adapter 42 may be inserted into the auxiliary channel 44 of the connector 22. The arms 46 of the T-adapter 42 engage the outer surface of the insulation sheet 40 to secure the sheet 40 against the corresponding panel 14.

In addition to the main dome structure 12, a number of accessories and modifications may be utilized to customize the structure. FIG. 1 shows a linking module 48 connecting the dome structure 12 to a similar dome structure 50. When used as a dwelling, the larger structure 12 could be used for living purposes and the smaller structure 50 for sleeping purposes.

FIG. 3 shows a vestibule 52 connected to the dome-shaped structure 12. The panels 54 and connectors 56 of the vestibule 52 are the same material and connected in the same manner as the materials in the main structure 12. A standard door 58 is mounted in the vestibule 52.

Figure 7:
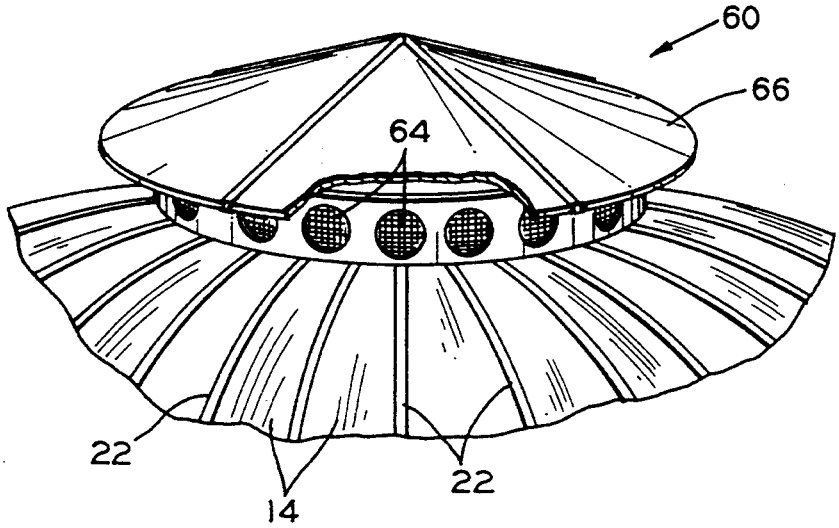
FIG. 7 is a perspective vies of a cover for the opening at the top of the dome.

FIG. 7 shows a ventilation cap 60 mounted over the aperture 62 in the top of the dome structure 12. The ventilation cap 60 is secured to the top edge 16 of the panels 14 by brackets or other means. Air vents with screens 64 may be opened to permit outside air to enter the structure 12. The rain cover 66 of the ventilation cap 60 may be made of a clear or translucent material to serve as a sky light for the structure 12. The structure 12 has no corners and air may be circulated very efficiently within the structure 12. A small bidirectional fan (not shown) mounted in the aperture 62 may be used to circulate air for both heating and cooling purposes.

The base edge 16 of the panels 14 may be connected to a bracket-shaped base 68 by bolts, rivets or other fastening means once the structure 12 has been formed.

FIGS. 8–11 disclose the initial steps in erecting the dome-shaped structure 12. The panels 14 are connected in series until all of the panels for the structure have been connected, at which time the two free ends 70 and 72 are connected to complete the structure 12.

Figure 8:
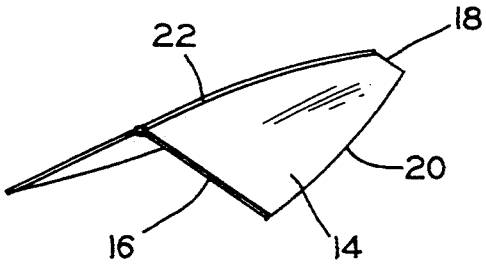
FIGS. 8, 9, and 10 show the initial steps in the assembly of the dome-shaped structure.

In FIG. 8, the first two panels 14 are being inserted into the connector 22. Because the side edges 20 are not straight, the person assembling the structure must use force to twist the panels 14 into the connector 22. This twisting causes the panels 14 to flex into a non-planar condition.

Figure 9:
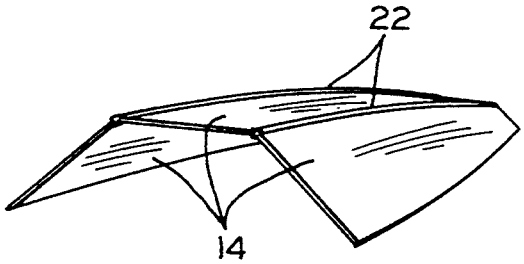
Figure 10:
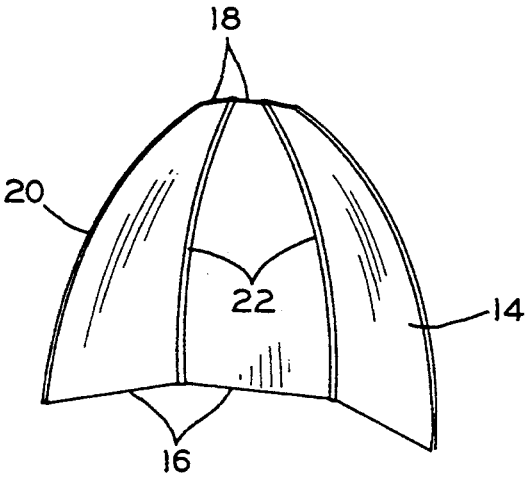
Figure 11:
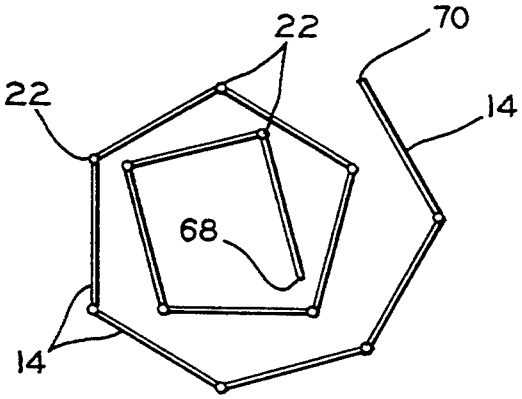
FIG. 11 shows a schematic of the top view of the panels connected in series to form a spiral prior to formation of the dome.

A third panel 14 is added in series as shown in FIGS. 9–10. After three panels 14 have been assembled, the partial structure is moved from a horizontal to a vertical position. As additional panels 14 are added, the force needed to insert the curved edge 20 causes the series of panels 14 to spiral as shown in FIG. 11.

After all the panels 14 have been connected in series, the spiral is unwound. The two free ends 70 and 72 of the series of panels are connected and the base edges 16 of the panels 14 are move into a circular configuration. As the spiral of panels 14 is unwound, tension forces are transferred to the top portions of the panels 14 and connectors 22 which causes the panels 14 and connectors 22 to be flexed into the desired dome position. As a generally circular base shape is achieved, the structure is formed into a dome shape with the structural rigidity and strength to provide temporary or permanent shelter.

The panels 14 may be stored and transported in a planar condition, which significantly reduces the shipping space and cost requirements. Only three major components are required for construction of the structure 12: the panels 14, elongate connectors 22, and locking caps 32. No special tools or construction skills are required, and the structure 12 can be set up by two individuals. The structure can be torn down and stored in a compact container until needed for future use.

In accordance with the provisions of the patent statutes, the present invention has been described in what is considered to represent its preferred embodiment. However, it should be noted that the invention can be practiced otherwise than a specifically illustrated and described without departing from its spirit or scope.

What is claimed is:

1. A dome-shaped structure comprising:

a) a plurality of flexible panels, said panels being provided with a base, a pair of arcuate side edges, and a top edge;

b) flexible connector means forcibly attached to the side edges of said panels for joining said plurality of panels to form an enclosure;

c) a plurality of panel coverings provided with a base, a pair of arcuate side edges, and a top edge, and positioned in spaced-apart relationship to an outer surface of said plurality of flexible panels;

d) a flexible, T-shaped mounting means for securing said plurality of panel coverings to said flexible connector means, said T-shaped mounting means including a base end positioned in an external center channel in said flexible connector means, whereby the force required to attach said flexible connector means to the arcuate side edges causes said panels and said panel coverings to flex inward to form a dome-shaped structure having inner panels and outer panel coverings.

2. A dome-shaped structure comprising:

a) a plurality of flexible panels, said panels being provided with a base, a pair of arcuate side edges, and a top edge;

b) flexible connector means forcibly attached to the side edges of said panels for joining said plurality of panels to form an enclosure;

c) a plurality of panel coverings provided with a base, a pair of arcuate side edges, and a top edge, and positioned in spaced-apart relationship to an outer surface of said plurality of flexible panels;

d) a flexible, T-shaped mounting means for securing said plurality of panel coverings to said flexible connector means, said T-shaped mounting means including a base end positioned in an external center channel in said flexible connector means, whereby the force required to attach said flexible connector means to the arcuate side edges causes said panels and said panel coverings to flex inward to form a dome-shaped structure having inner panels and outer panel coverings.

3. The dome-shaped structure defined in claim 2 wherein the panel coverings include insulation panels.

4. The dome-shaped structure defined in claim 2 wherein said flexible connector means includes a pair of elongate, flexible U-shaped caps secured about the full length of the arcuate side edges of said flexible panels, said U-shaped caps provided with curved ends having a segment angled from the surfaces of the panels, and a plurality of elongate H-shaped connectors, each connector forming two longitudinal channels for retaining and securing the caps of adjacent flexible panels, and having a longitudinal channel integrally formed on the side of the H-shaped connectors for receiving and securing the base of said T-shaped mounting means.

5. The dome-shaped structure defined in claim 2 including an aperture cover secured to the top edges of said flexible panels, said cover being made from a material which transmits light, and including air vents with screens, whereby light and air are communicated between the outside and inside of the dome-shaped structure through said cover.

* * * * *